US010883411B2

(12) United States Patent
van den Heuvel et al.

(10) Patent No.: US 10,883,411 B2
(45) Date of Patent: Jan. 5, 2021

(54) SYSTEMS AND METHODS FOR AN EXHAUST-GAS AFTERTREATMENT DEVICE

(71) Applicant: Ford Global Technologies, LLC, Dearborn, MI (US)

(72) Inventors: Bas van den Heuvel, Wijnandsrade (NL); Richard Fritsche, Wermelskirchen (DE); Brendan Patrick Carberry, Aachen (DE); Felix Goebel, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/432,852

(22) Filed: Jun. 5, 2019

(65) Prior Publication Data

US 2019/0376436 A1 Dec. 12, 2019

(30) Foreign Application Priority Data

Jun. 6, 2018 (DE) ..... 10 2018 208 921
Jun. 6, 2018 (DE) ..... 10 2018 208 922
Jun. 6, 2018 (DE) ..... 10 2018 208 924

(51) Int. Cl.
*F01N 13/00* (2010.01)
*F01N 3/28* (2006.01)
(Continued)

(52) U.S. Cl.
CPC ..... *F01N 13/0097* (2014.06); *F01N 3/035* (2013.01); *F01N 3/28* (2013.01);
(Continued)

(58) Field of Classification Search
CPC ..... F01N 13/0097; F01N 3/035; F01N 3/28; F01N 13/0093; F01N 13/141;
(Continued)

(56) References Cited

U.S. PATENT DOCUMENTS 5,043,147 A * 8/1991 Knight ..... F01N 1/084 181/232
5,484,575 A 1/1996 Steenackers
(Continued)

FOREIGN PATENT DOCUMENTS

DE 102010034705 A1 2/2012
DE 102013210799 A1 12/2014
(Continued)

OTHER PUBLICATIONS

Laurell, M. et al., "The innovative exhaust gas aftertreatment system for the new Volvo 4 Cylinder Engines; a unit catalyst system for gasoline and diesel cars," Proceedings of the 22nd Aachen Colloquium Automobile and Engine Technology 2013, Oct. 7, 2013, Aachen, Germany, 20 pages.

*Primary Examiner* — Hoang M Nguyen
(74) *Attorney, Agent, or Firm* — Geoffrey Brumbaugh McCoy Russell LLP

(57) ABSTRACT

Methods and systems are provided for an exhaust-gas aftertreatment device. In one example, an exhaust-gas aftertreatment device comprises a housing with a first can comprising a first catalytic converter and a second can comprising a second catalytic converter, wherein the first catalytic converter is not concentric with the first can.

19 Claims, 8 Drawing Sheets

(51) Int. Cl.
*F01N 13/14* (2010.01)
*F01N 3/035* (2006.01)

(52) U.S. Cl.
CPC ..... *F01N 3/2889* (2013.01); *F01N 13/0093* (2014.06); *F01N 13/141* (2013.01)

(58) Field of Classification Search
CPC .. F01N 3/2889; F01N 3/2839; F01N 2470/06; F01N 2470/08; F01N 13/1888
USPC ..... 60/282, 299
See application file for complete search history.

(56) References Cited

U.S. PATENT DOCUMENTS 5,589,144 A 12/1996 Filippi et al.
5,611,198 A * 3/1997 Lane ..... B01D 53/9409 60/299
5,804,147 A * 9/1998 Blanchet ..... F01N 13/009 422/169
5,878,567 A * 3/1999 Adamczyk, Jr. ..... B01D 53/945 60/274
6,444,177 B1 9/2002 Muller et al.
7,273,592 B2 * 9/2007 Jacob ..... F01N 1/24 181/212
7,611,561 B2 11/2009 Hill, Jr. et al.
7,849,676 B2 12/2010 Witte-Merl
8,015,802 B2 9/2011 Nishiyama et al.
8,250,859 B2 8/2012 Torisaka et al.
8,276,372 B2 10/2012 Kowada
8,322,134 B2 12/2012 Wieland et al.
8,394,332 B2 3/2013 Honda et al.
8,501,104 B2 8/2013 Honda et al.
8,539,758 B2 9/2013 Muller-Haas
8,938,945 B2 1/2015 Hylands et al.
8,950,175 B2 2/2015 Laurell et al.
8,978,366 B2 3/2015 Brugger
9,322,309 B2 4/2016 Beyer et al.
9,364,790 B2 6/2016 Sampath et al.
9,410,460 B2 8/2016 Hackländer
9,488,090 B2 11/2016 Spengel et al.
9,624,815 B2 4/2017 Davison et al.
2001/0049936 A1 12/2001 Kenneth et al.
2006/0008397 A1 1/2006 Bruck
2006/0107656 A1 5/2006 Bruck
2008/0041042 A1 2/2008 Sinha et al.
2008/0314033 A1 * 12/2008 Aneja ..... F01N 3/2066 60/297
2011/0162358 A1 * 7/2011 Bruck ..... F01N 13/14 60/605.1
2014/0260204 A1 9/2014 Sugiyama
2015/0285115 A1 10/2015 Plati et al.
2016/0115848 A1 4/2016 Kurikka et al.
2017/0122180 A1 5/2017 Lee et al.
2017/0218824 A1 8/2017 Grosch et al.

FOREIGN PATENT DOCUMENTS

EP 0514326 A1 11/1992
JP 2009167806 A 7/2009
JP 5361688 B1 12/2013
WO 2016107807 A1 7/2016

* cited by examiner

SYSTEMS AND METHODS FOR AN EXHAUST-GAS AFTERTREATMENT DEVICE

CROSS REFERENCE TO RELATED APPLICATIONS

The present application claims priority to German patent application No. 102018208922.1, filed on Jun. 6, 2018, German patent application No. 102018208921.3, filed on Jun. 6, 2018, and German patent application No. 102018208924.8, filed on Jun. 6, 2018. The entire contents of each of the above-listed applications are hereby incorporated by reference for all purposes.

FIELD

The present description relates generally to an exhaust-gas aftertreatment device.

BACKGROUND/SUMMARY

With increasingly stringent emissions standards, components utilized for aftertreatment purposes may begin to occupy a greater volume of space in an engine compartment. To this effect, there is a demand to decrease a packaging size of aftertreatment systems while still meeting emissions standards.

Other examples of addressing aftertreatment packaging sizes include arranging flow ducts configured to reverse exhaust gas flow. One example approach is shown by Brugger in U.S. Pat. No. 8,978,366. Therein, a first catalyst is arranged in a first housing and receives exhaust gas in a first direction. A second catalyst is arranged in a second housing, wherein the second catalyst receives exhaust gas in a second direction opposite to the first direction.

However, the inventors have identified some issues with the approaches described above. For example, the first catalyst is arranged in a biased position in the first housing to further mitigate the reaction agent from emerging directly through an outlet of the first housing. However, a backflow region of the first housing in a lower part comprises a larger cross-section than the backflow region of the first housing in an upper part. By doing this, a venturi effect may be generated at an intersection where the outflow region and the backflow region meet due to gas flow from the upper part through the outflow region. This effect may lead to uneven exhaust gas flow through the first catalyst which may lead to uneven loading of the catalyst and inadequate exhaust gas treatment.

In another example of Brugger, the first catalyst is arranged symmetrically in the first housing. However, in this example, while the venturi effect may be reduced and loading of the first catalyst may be more even, a space between the first housing and the second housing may be increased due to thermal transfer between the housings. As such, a packaging space of the aftertreatment system may still be relatively high.

In one example, the issues described above may be addressed by a system for an exhaust-gas aftertreatment housing comprising a catalytic converter comprising a diameter smaller than a diameter of a can of the exhaust-gas aftertreatment housing, wherein the catalytic converter is pressed against an interior surface of the can. In this way, exhaust gas leaving the first catalytic converter flows through only a single flow duct toward the second catalytic converter such that the venturi effect described above is avoided.

As one example, the first catalytic converter is arranged within the can to maximize a space between the first catalytic converter and the second catalytic converter. In this way, heat transfer between the first catalytic converter and the second catalytic converter may be reduced. Furthermore, to further reduce heat transfer between the first catalytic converter and the second catalytic converter, a thermally insulating device may be arranged between the first catalytic converter and the second catalytic converter.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
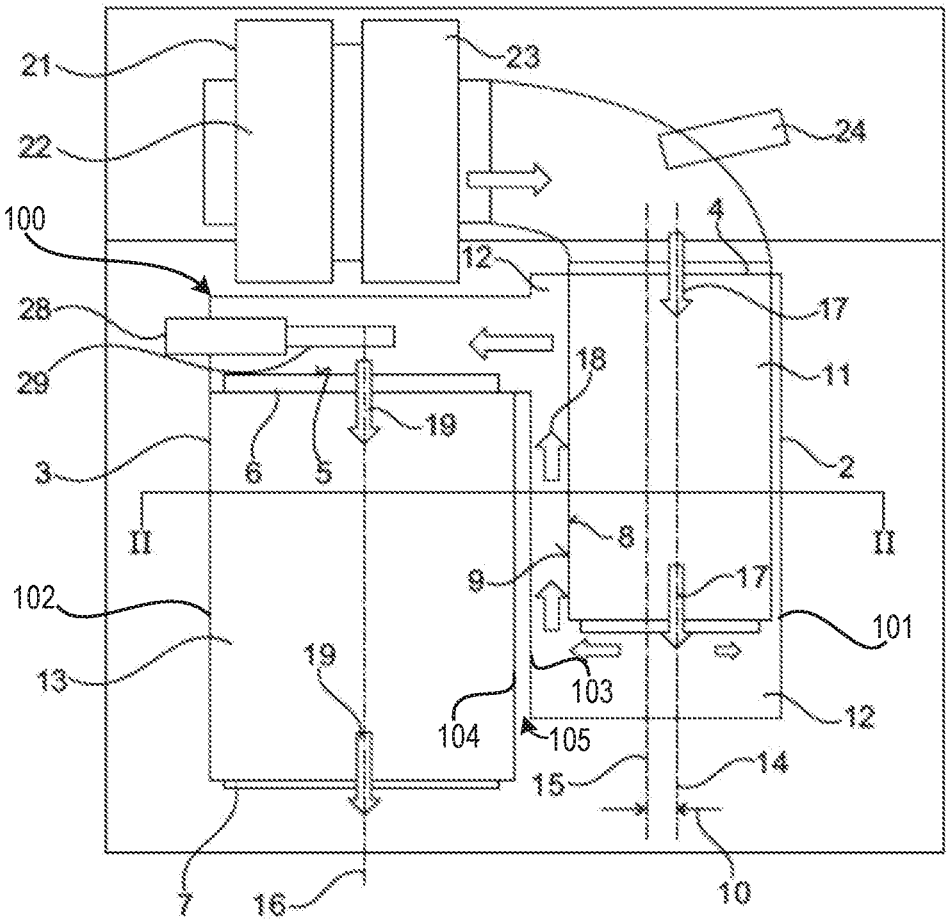
FIG. 1 illustrates a schematic view of an exhaust-gas aftertreatment device.
Figure 2:
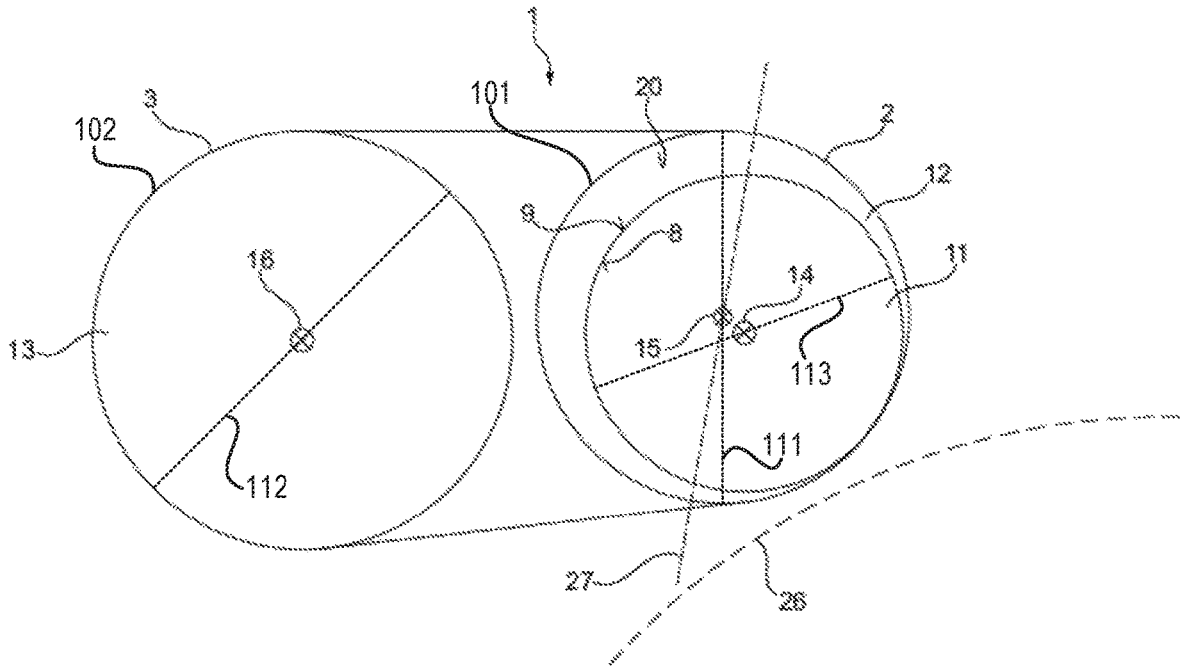
FIG. 2 illustrates a first arrangement of the catalytic converters within their respective housings.
Figure 3:
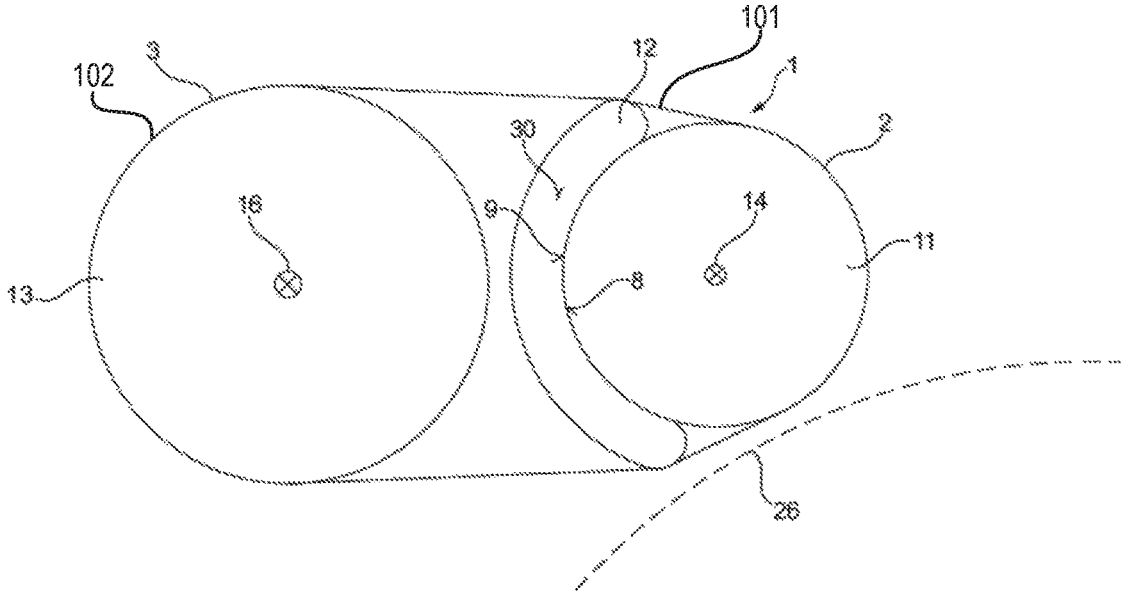
FIG. 3 illustrates a second arrangement of the catalytic converter within their respective housings.
Figure 4B:
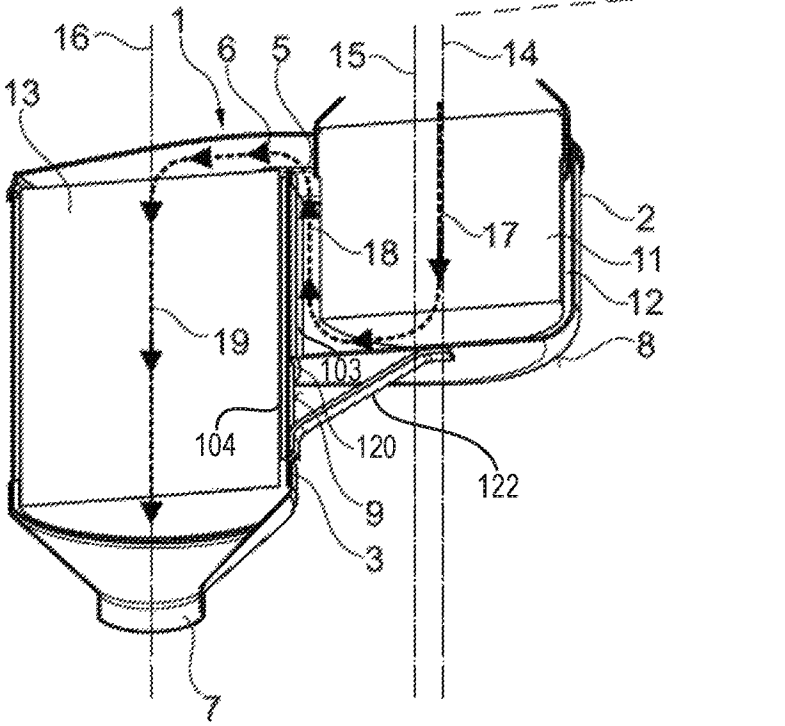
FIG. 4B illustrates a schematic view of the first embodiment.
Figure 4A:
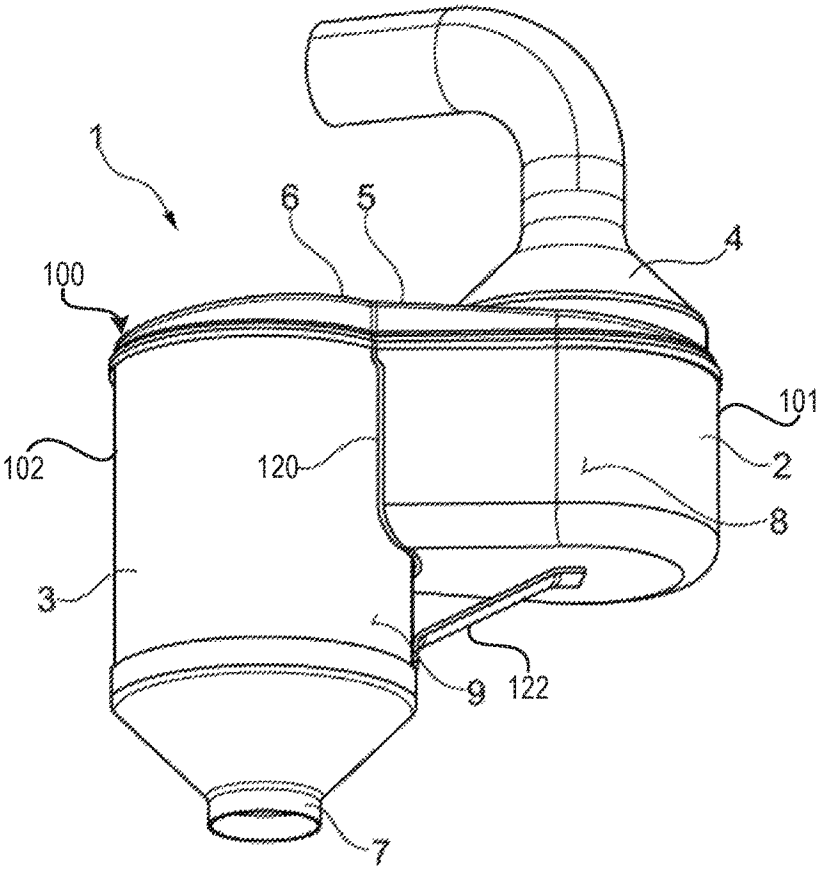
FIG. 4A illustrates a perspective view of a first embodiment of an exhaust-gas aftertreatment device.
Figure 5B:
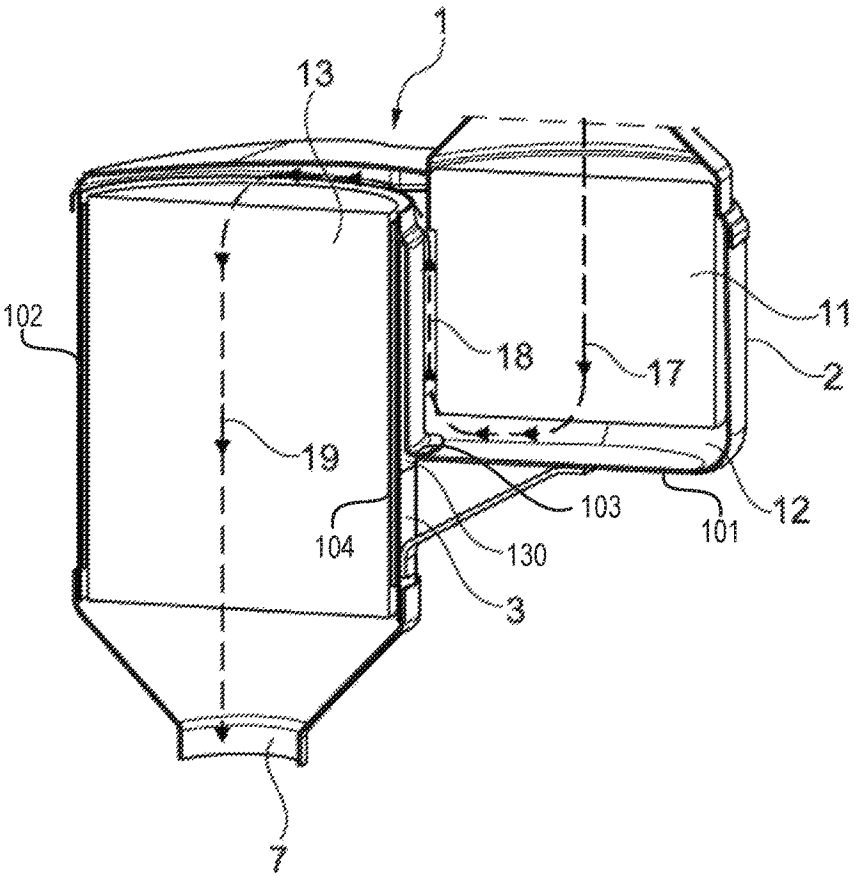
FIG. 5B illustrates a schematic view of the second embodiment.
Figure 5A:
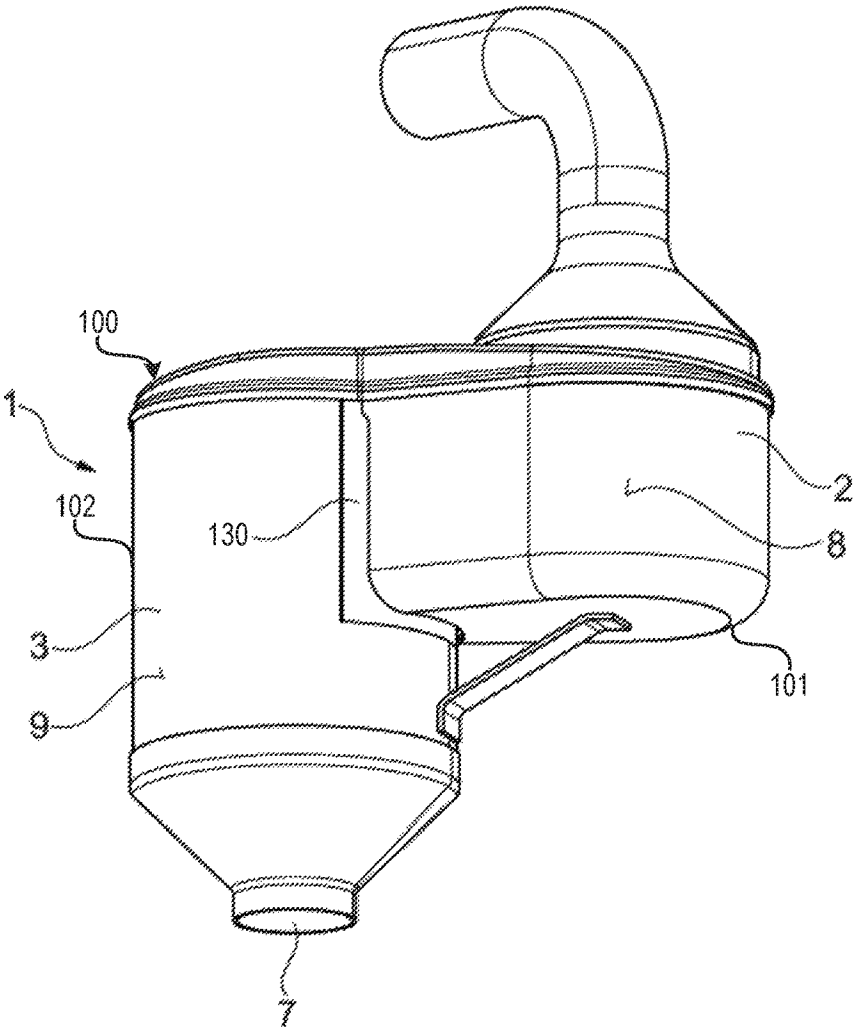
FIG. 5A illustrates a perspective view of a second embodiment of an exhaust-gas aftertreatment device.
Figure 6B:
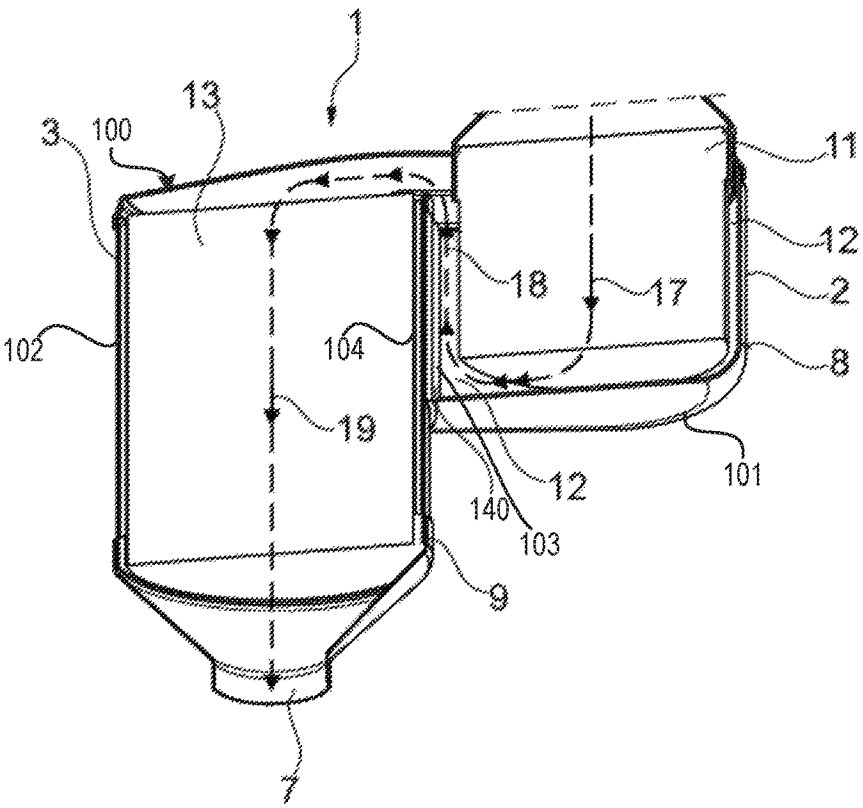
FIG. 6B illustrates a schematic view of the third embodiment.
Figure 6A:
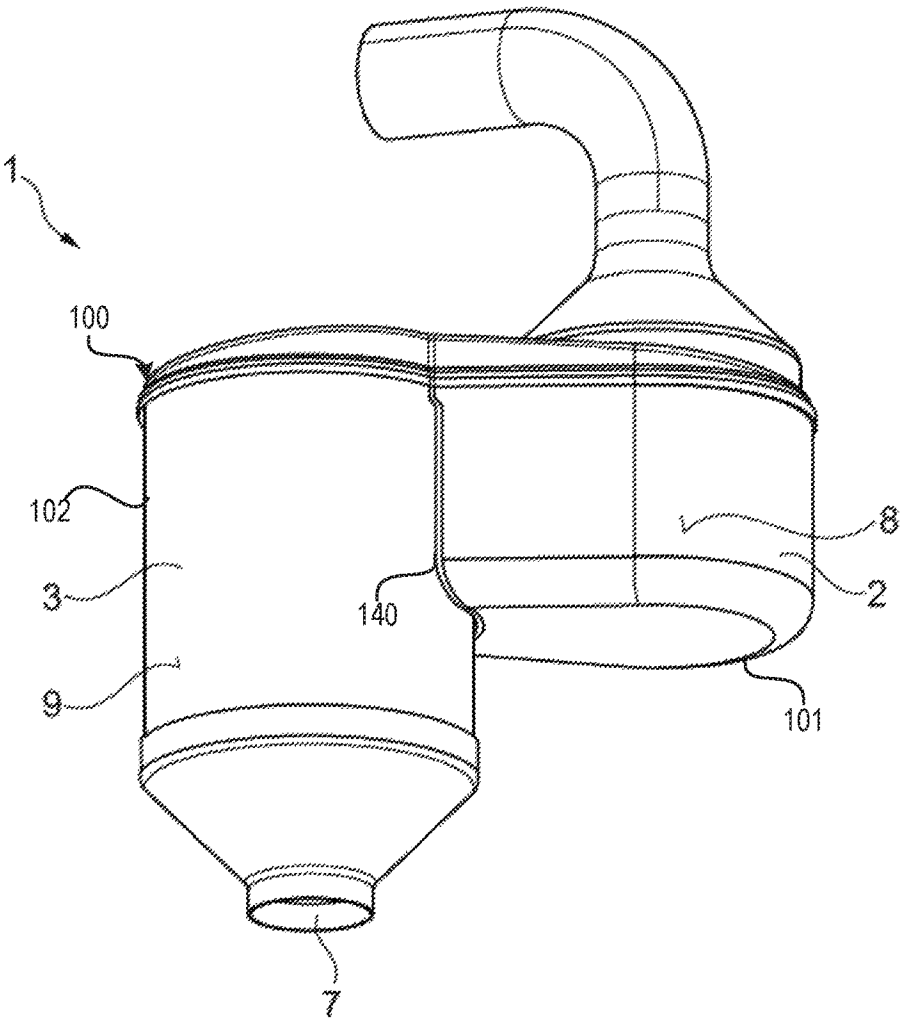
FIG. 6A illustrates a perspective view of a third embodiment of an exhaust-gas aftertreatment device.
Figure 7B:
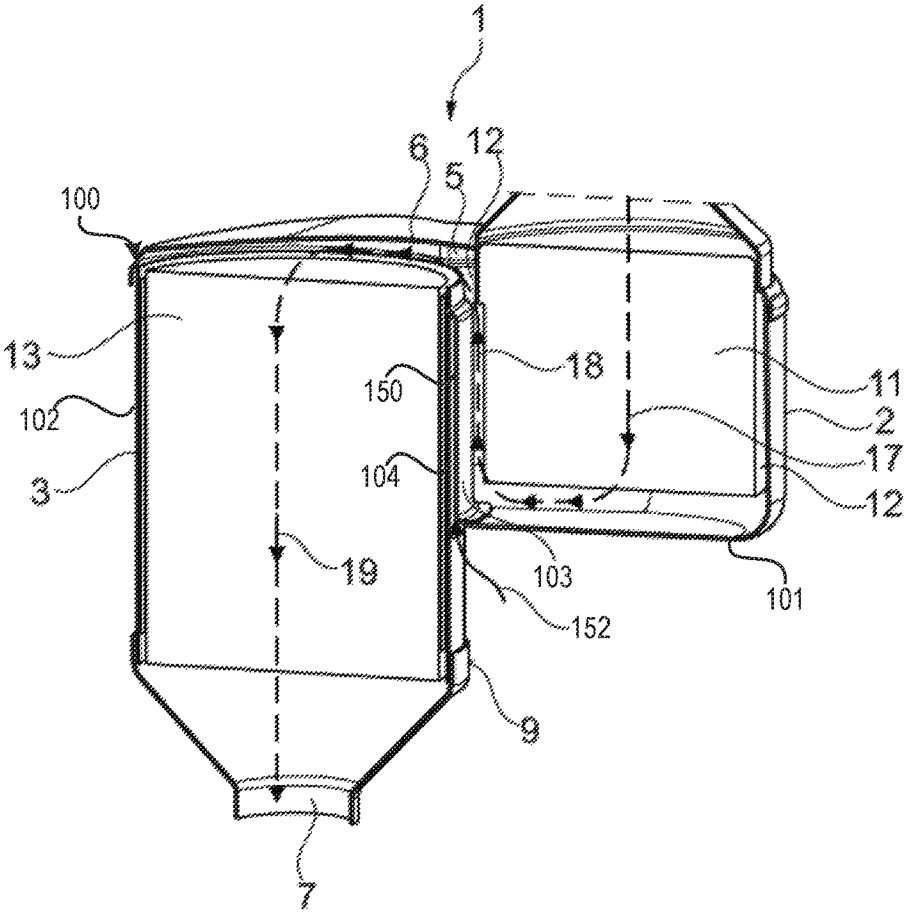
FIG. 7B illustrates a schematic view of the fourth embodiment.
Figure 7A:
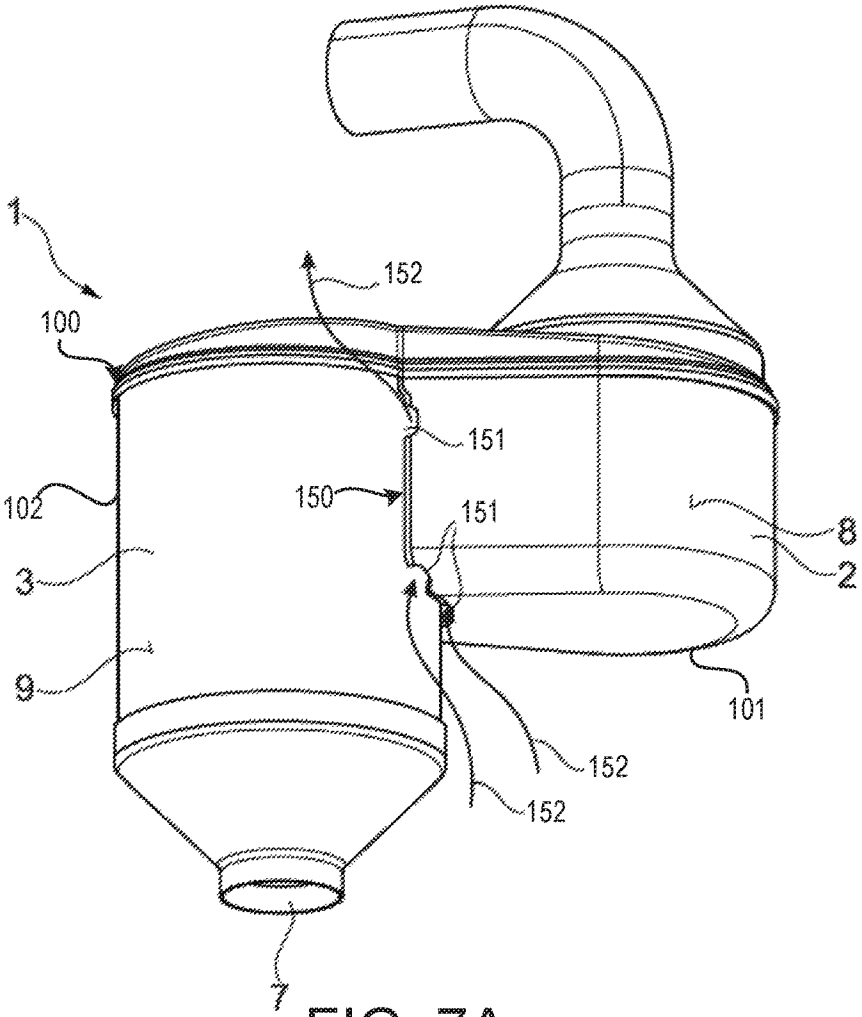
FIG. 7A illustrates a perspective view of a fourth embodiment of an exhaust-gas aftertreatment device.
Figure 8B:
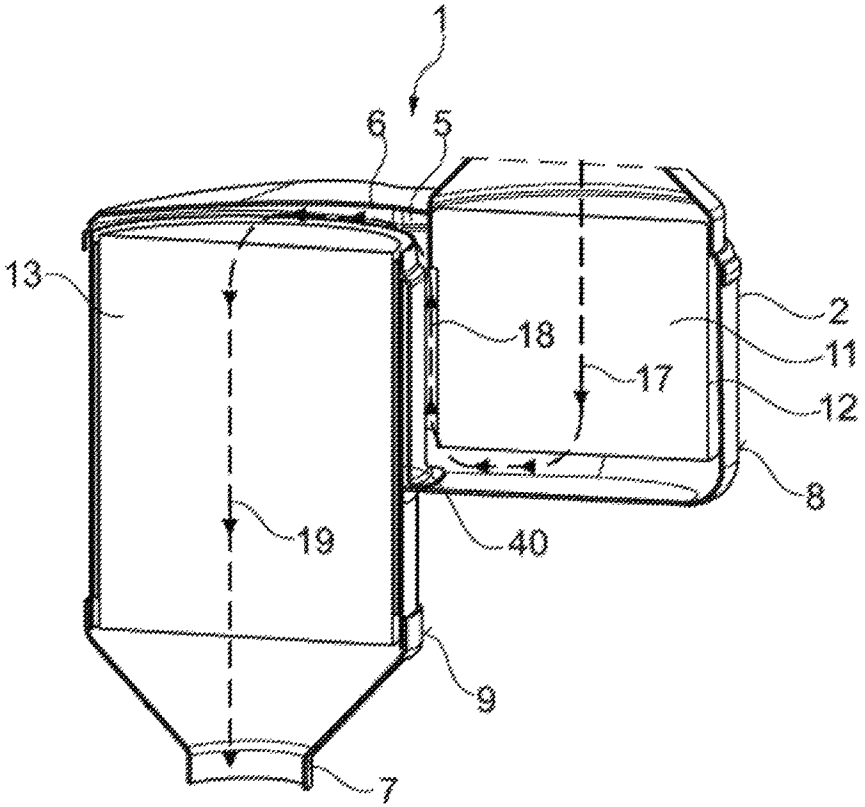
FIG. 8B illustrates a schematic view of the fifth embodiment.
Figure 8A:
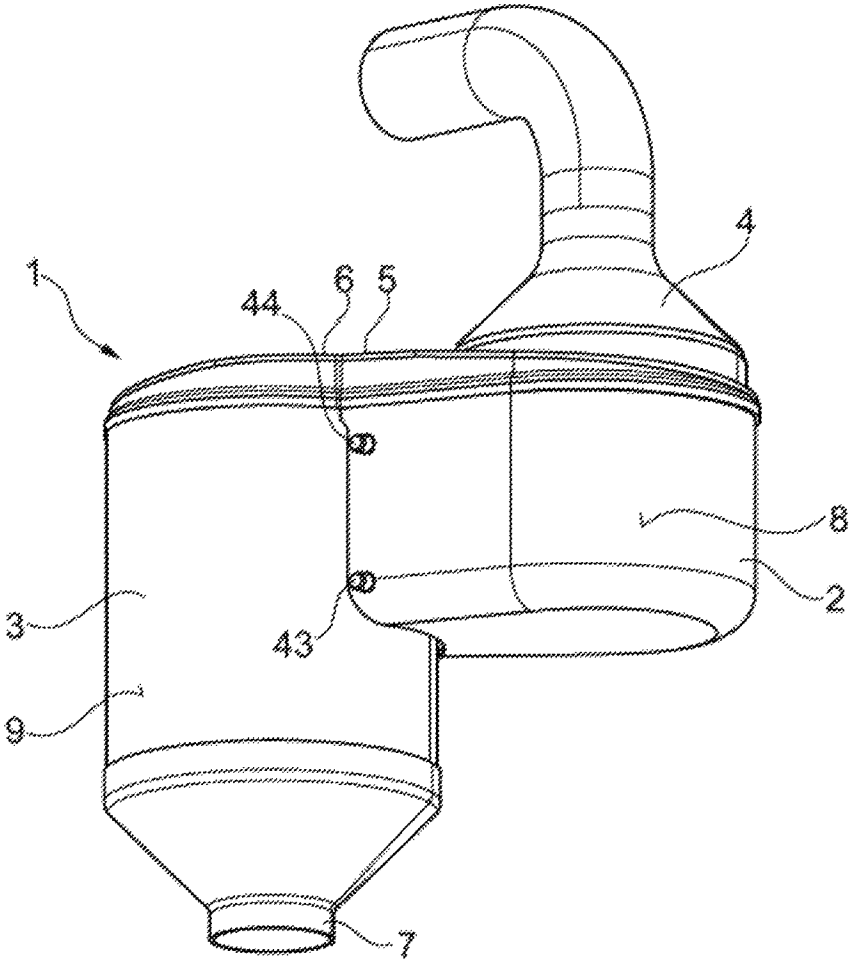
FIG. 8A illustrates a perspective view of a fifth embodiment of an exhaust-gas aftertreatment device.
Figure 9:
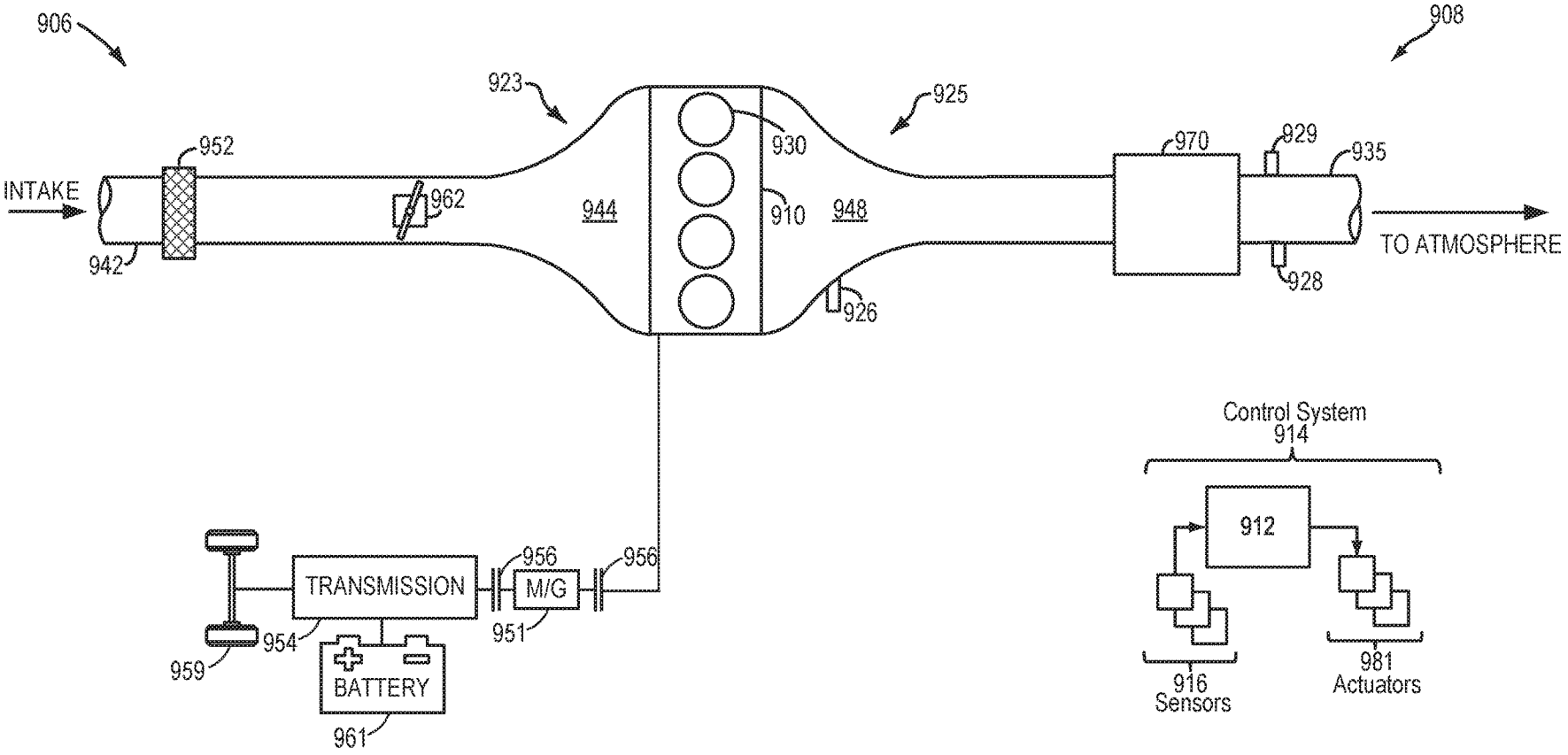
FIG. 9 illustrates an engine for a hybrid vehicle, the engine comprising an exhaust passage fitted with the exhaust-gas aftertreatment device.

The following description relates to systems and methods for an exhaust-gas aftertreatment device. FIG. 1 illustrates a schematic view of an exhaust gas aftertreatment device. FIG. 2 illustrates a first arrangement of the exhaust-gas aftertreatment device. FIG. 3 illustrates a second arrangement of the exhaust-gas aftertreatment device. FIGS. 4A and 4B illustrate a first embodiment of the exhaust-gas aftertreatment device. FIGS. 5A and 5B illustrate a second embodiment of the exhaust-gas aftertreatment device. FIGS. 6A and 6B illustrate a third embodiment of the exhaust-gas aftertreatment device. FIGS. 7A and 7B illustrate a fourth embodiment of the exhaust-gas aftertreatment device. FIGS. 8A and 8B illustrate a fifth embodiment of the exhaust-gas aftertreatment device. FIG. 9 illustrates a schematic for a hybrid vehicle comprising an engine having an exhaust passage, wherein the exhaust-gas aftertreatment device of the present disclosure may be arranged.

The exhaust-gas aftertreatment device according to the present disclosure comprises a first catalytic converter and a second catalytic converter following the first catalytic converter in the direction of flow of the exhaust gas. The first and the second catalytic converter may be arranged spatially adjoining one another, for example side by side. The first catalytic converter comprises a first flow duct and a second flow duct. The first catalytic converter is configured to carry exhaust gas through the first flow duct in a first direction of flow and then to carry it through the second flow duct in a second direction of flow running counter to the first direction of flow. The second catalytic converter comprises a third flow duct. The second flow duct of the first catalytic converter is arranged, spatially and in terms of the flow, between the first flow duct of the first catalytic converter and the third flow duct of the second catalytic converter. The second catalytic converter is configured to carry exhaust gas leaving the second flow duct of the first catalytic converter through the second catalytic converter in a third direction of flow running counter to the second direction of flow. The third direction of flow may run parallel to the first direction of flow, for example.

A distinctive feature of the exhaust-gas aftertreatment device according to the disclosure is that the first flow duct has a central axis and the second flow duct has a central axis which is arranged radially offset in relation to the central axis of the first flow duct. This has the advantage that the device takes up less overall storage space than in a concentric arrangement in which the central axes of the first flow duct and the second flow duct are identical. A further advantage lies in the thermal insulation of the first flow duct afforded by the second flow duct.

In an additional embodiment, the first flow duct comprises an outside wall, the second flow duct comprises an outside wall and at least a part of the outside wall of the first flow duct forms at least a part of the outside wall of the second flow duct. This variant is particularly space-saving. The examples described below also each have the advantage that they provide space-saving solutions. The outside walls may be shared due, at least in part, to the radially offset arrangement of the second flow duct such that an air gap is shaped between a first catalyst and the second flow duct.

In a further examples, the second flow duct may at least partially enclose the first flow duct in a circumferential direction. In other words, in this variant the second flow duct is arranged radially outside the first flow duct, relative to the central axis of the first flow duct, and at least partially encloses the latter. In particular, the second flow duct may enclose the first flow duct completely in a circumferential direction. The second flow duct may have a cross-sectional area, for example, which has the shape of an open or closed ring.

In another examples, the second flow duct has an asymmetrical cross-sectional area at least in relation to a radial axis. The asymmetrical configuration affords a flexible adaptation to the particular stowage space available without adversely affecting the working of the exhaust-gas aftertreatment device. In particular, the second flow duct may have a free-form cross-sectional area. This has the particular advantage that specific account can be taken of individual stowage space factors and the space available in each instance can thereby be exploited to the full.

In the context of the present disclosure, directions of flow running counter to one another implies that the corresponding flow ducts each have central axes which enclose an angle of 135 degrees (135°) to 180 degrees (180°) or of 0 degrees (0°) to 45 degrees (45°). In an advantageous variant the first flow duct has a central axis and/or the second flow duct has a central axis and/or the third flow duct has a central axis. The central axes may in each case enclose an angle of 0 degrees (0°) to 45 degrees (45°), for example 0 degrees (0°) to 20 degrees (20°), preferably an angle of 0 degrees (0°) to 5 degrees (5°).

The first direction of flow and the second direction of flow and/or the second direction of flow and the third direction of flow may enclose an angle of 135 degrees to 225 degrees. Said central axes may each define the direction of flow in the respective flow duct. The central axis of the first flow duct may define the first direction of flow, for example, the central axis of the second flow duct may define the second direction of flow and the central axis of the third flow duct may define the third direction of flow.

At least one of the catalytic converters may comprise an SCR catalytic converter, for example an SCR filter, and/or a lean NOx trap (LNT) and/or a diesel particle filter. The first catalytic converter comprises a lean NOx trap and the second catalytic converter an SCR catalytic converter, in one example.

In another example, the first catalytic converter and the second catalytic converter are arranged inside a common housing. The first catalytic converter may have a central axis and the second catalytic converter may have a central axis, wherein the central axes may run parallel to one another. In a further variant the first flow duct of the first catalytic converter may have a central axis and the second flow duct may be arranged radially outside the first flow duct. It may, in particular, radially enclose the first flow duct.

The device according to the disclosure is configured for the aftertreatment of exhaust gas from a combustion engine, in particular a motor vehicle combustion engine. A supercharger, for example a turbocharger, and/or an evaporator may be arranged upstream of the first catalytic converter.

In another embodiment, the device according to the disclosure for exhaust gas after-treatment comprises a first catalytic converter apparatus and a second catalytic converter apparatus which adjoins the first catalytic converter apparatus in the direction of flow of the exhaust gas. The first and the second catalytic converter apparatuses are arranged spatially adjacent to one another, for example, next to one another. The first catalytic converter apparatus comprises a first flow duct and a second flow duct. The first catalytic converter apparatus is configured to conduct exhaust gas in a first direction of flow through the first flow duct and subsequently through the second flow duct in a second direction of flow running opposite to the first direction of flow. The second catalytic converter apparatus comprises a third flow duct. The second flow duct of the first catalytic converter apparatus is arranged spatially and in terms of flow between the first flow duct of the first catalytic converter apparatus and the third flow duct of the second catalytic converter apparatus. The second catalytic converter apparatus is configured to conduct exhaust gas, after leaving the second flow duct of the first catalytic converter apparatus, through the second catalytic converter apparatus in a third direction of flow running opposite to the second direction of flow. The third direction of flow can run, for example, parallel to the first direction of flow. At least one means for heat insulation is arranged spatially between the first catalytic converter apparatus and the second catalytic converter apparatus. The means for heat insulation is preferably arranged spatially between the second flow duct and the third flow duct.

The device according to the disclosure has the advantage that high temperatures which occur in particular in the context of regeneration processes in the first catalytic converter apparatus or in the second catalytic converter apparatus influence the respective other catalytic converter apparatus to a reduced extent as a result of heat radiation or heat flow. The undesirable temperature gradients described above are reduced in this manner. In this way, the combination of the air gap described above, which is shaped due to the radially offset arrangement of the second flow duct, may be enhanced via the thermally insulating material. By doing this, the second and third flow ducts may be arranged spatially closer to one another than the flow ducts described in previous examples.

In one example, the first catalytic converter apparatus and the second catalytic converter apparatus are arranged within a common housing. The first catalytic converter apparatus can comprise a central axis and the second catalytic converter apparatus can comprise a central axis, wherein the central axes can run parallel to one another. In a further variant, the first flow duct of the first catalytic converter apparatus can comprise a central axis and the second flow duct can be arranged radially outside the first flow duct. It can in particular radially enclose the first flow duct.

The first catalytic converter apparatus can comprise a first outer wall, the second catalytic converter apparatus can comprise a second outer wall and the at least one element for heat insulation can be arranged between the first outer wall of the first catalytic converter apparatus and the second outer wall of the second catalytic converter apparatus. This arrangement has the advantage that the outer walls of the first and second catalytic converter apparatus do not have to be fully insulated and thus the costs which arise in conjunction with such a solution can be saved. The device according to the disclosure for exhaust gas after-treatment can comprise more than two catalytic converter apparatuses which, in the manner described, adjoin one another spatially and in terms of flow, for example, can be arranged next to one another. At least one of the catalytic converter apparatuses of the device according to the disclosure can comprise a diesel particle filter.

The element for heat insulation can comprise a mat, in particular be configured as a mat. In this case, the mat can have heat-insulating properties, for example, comprise heat-insulating material or be composed of heat-insulating material.

For example, E-glass fiber fabrics/mats, silicate fiber fabrics/mats or mineral fiber mats can be used as suitable materials and forms of application to insulate extremely hot components. The insulation efficiency may be dependent on the thickness of the fabric/mats or the number of layers used.

In a further example, the element for heat insulation can comprise a coating, in particular, be configured as a coating. In this case, a heat-insulating layer may be present on a surface region of the outer wall of the first and/or the second catalytic converter apparatus. The region of the outer wall which adjoins the outer wall of the respective other catalytic converter apparatus or is arranged adjacent thereto is advantageously coated in this case. The advantage of an only partial coating of the outer surface of one or both catalytic converter apparatuses lies in the fact that only a small surface may be coated and thus costs relative a complete coating can be reduced.

In a further example, the element for heat insulation can comprise at least one sealed-off cavity. The cavity can be filled, for example, with air or a different gas or contain a vacuum. A sealed-off air layer is preferably present between the first catalytic converter apparatus and the second catalytic converter apparatus. The sealed-off cavity can, for example, be realized in that an air volume sealed off by metal walls, for example, metal plates, is generated. As such, the cavity may comprise a double-wall configuration with a gap between the two walls, wherein the gap is filled with air or a liquid.

In one example, the element for heat insulation comprises a number of flow ducts. For example, air flow ducts can be present between the first catalytic converter apparatus and the second catalytic converter apparatus, in particular at least one flow duct with an air inlet and an air outlet, wherein air for cooling can flow through the at least one flow duct. The outer walls of the catalytic converter apparatuses can shape wall regions of the flow ducts, in particular of the at least one air flow duct. In this manner, passive cooling is realized.

In a further example, at least one flow duct, for example, a number of flow ducts, is/are arranged between the first catalytic converter apparatus and the second catalytic converter apparatus, in particular between the outer wall of the first catalytic converter apparatus and the outer wall of the second catalytic converter apparatus, the at least one flow duct being designed for a fluid, in particular a cooling fluid, to flow through it. The at least one flow duct can comprise an inlet and an outlet. A cooling fluid, for example, a gas, such as in particular air, or a liquid, such as, for example, water or oil, can be conducted through the flow duct.

In the context of the method according to the disclosure for operating a device for exhaust gas after-treatment which comprises a number of flow ducts as an element for heat insulation, a fluid, preferably a cooling fluid, such as, for example, air, water, or oil, is conducted, for example, pumped, through at least one of the flow ducts. The method according to the disclosure has the advantages cited in conjunction with the device according to the disclosure. It has in particular the advantage that active cooling is enabled which can be flexibly adapted to the respectively occurring temperatures. For example, in the event of a regeneration of one of the catalytic converter apparatuses, cooling fluid can be conducted with a specific throughflow rate through the at least one flow duct. In this manner, efficient cooling is available which is particularly efficient since it can be used in a controlled manner as required.

In another embodiment, additionally or alternatively, the apparatus for exhaust-gas aftertreatment according to the disclosure comprises a first catalytic converter device and a second catalytic converter device which adjoins the first catalytic converter device in a direction of flow of the exhaust gas. The first and the second catalytic converter devices are arranged in a manner spatially adjoining one another, for example are arranged alongside one another. The first catalytic converter device comprises a first flow duct and a second flow duct. The first catalytic converter device is configured to conduct exhaust gas in a first direction of flow through the first flow duct and then to conduct it in a second direction of flow running opposite to the first direction of flow through the second flow duct. The second catalytic converter device comprises a third flow duct. The second flow duct of the first catalytic converter device is arranged spatially and fluidically between the first flow duct of the first catalytic converter device and the third flow duct of the second catalytic converter device. The second catalytic converter device is configured to conduct exhaust gas, after it has left the second flow duct of the first catalytic converter device, in a third direction of flow running opposite to the second direction of flow through the second catalytic converter device. The third direction of flow can run parallel to the first direction of flow, for example.

The apparatus for exhaust-gas aftertreatment according to the disclosure is distinguished by the fact that the second flow duct of the first catalytic converter device comprises an apparatus for injecting a reducing agent, for example urea or ammonia. The second flow duct of the first catalytic converter device moreover comprises an apparatus for mixing the reducing agent with exhaust gas. The apparatus for injecting and for mixing may be realized in one apparatus. Provision may thus be made of a single apparatus for injecting and mixing.

The apparatus according to the disclosure comprises where the apparatus for injecting, in particular the apparatus for injecting and/or the apparatus for mixing, can be arranged in the region of the second flow duct at a position which reduces or blocks a formation of deposits of, for example, ash, soot and converted urea substances on the walls of the first and/or of the third flow duct. In this respect, the arrangement may be provided in particular in such a way that gravitational effects are exploited.

In another example, the first flow duct comprises an exhaust-gas outlet and the third flow duct comprises an exhaust-gas inlet. The second flow duct comprises a first end and a second end. In this case, the first end is arranged at the exhaust-gas outlet of the first flow duct and the second end is arranged at the exhaust-gas inlet of the third flow duct. In this variant, the apparatus for injecting and/or the apparatus for mixing may be arranged at the first end of the second flow duct or at the second end of the second flow duct or at another position of the second flow duct. An arrangement at the second end of the second flow duct, in particular at the exhaust-gas inlet of the third flow duct, has the advantage that substances which can cause deposits are conducted through the third flow duct to an exhaust-gas outlet of the second catalytic converter device.

The third flow duct comprises an exhaust-gas inlet and an exhaust-gas outlet, the exhaust-gas inlet being arranged in a vertical direction above the exhaust-gas outlet. The apparatus for injecting and/or the apparatus for mixing is advantageously arranged in a vertical direction above the exhaust-gas inlet of the third flow duct. In this embodiment variant, the formation of deposits is minimized by exploiting gravitation.

An arrangement of the apparatus for injecting and/or of the apparatus for mixing at the first end of the second flow duct, in particular at the exhaust-gas outlet of the first flow duct, may be advantageous in the case of certain configurations from the point of view of efficient exploitation of the available storage space.

In another example, the first catalytic converter device and the second catalytic converter device are arranged within a common housing. The first catalytic converter device can comprise a center axis and the second catalytic converter device can comprise a center axis, it being possible for the center axes to run parallel to one another. In a further variant, the first flow duct of the first catalytic converter device can comprise a center axis and the second flow duct can be arranged radially outside the first flow duct. Said second flow duct can in particular radially surround the first flow duct. This case has the advantage that the first flow duct is thermally insulated by the second flow duct.

The apparatus according to the disclosure is configured for the aftertreatment of exhaust gas of an internal combustion engine, in particular of a motor vehicle internal combustion engine. A charger, for example a turbocharger, and/or an evaporator may be arranged upstream of the first catalytic converter device.

In the context of the method according to the disclosure for operating an apparatus for exhaust-gas aftertreatment as described above, exhaust gas, for example exhaust gas of an internal combustion engine, is conducted into the first flow duct of the first catalytic converter device. A reducing agent is injected into the exhaust gas leaving the first flow duct at the exhaust-gas outlet thereof in the region of the second flow duct via the apparatus for injecting a reducing agent. The exhaust gas is then conducted into the second catalytic converter device. In the context of the method, the exhaust gas can be mixed with the injected reducing agent via an apparatus for mixing. The method according to the disclosure has the advantages which have been described in conjunction with the apparatus according to the disclosure. In particular, the formation of undesired deposits is reduced or blocked by the method.

The motor vehicle according to the disclosure comprises an apparatus for exhaust-gas aftertreatment according to the disclosure as described above. It has the properties and advantages which have already been mentioned in this conjunction. The motor vehicle may be a passenger vehicle, a truck or a motorbike.

The disclosure will be explained in more detail herein below on the basis of exemplary embodiments and with reference to the attached figures. Although the disclosure will be illustrated and described in more detail by the preferred exemplary embodiments, the disclosure is not limited by the disclosed examples, and other variations may be derived therefrom by a person skilled in the art without departing from the scope of protection of the disclosure.

FIGS. 1-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIGS. 1 and 2 show a first example an exhaust-gas aftertreatment device 1 according to the disclosure. The exhaust-gas aftertreatment device 1 according to the disclosure comprises a first catalytic converter 2 and a second catalytic converter 3. The first catalytic converter 2 comprises an exhaust-gas inlet 4 and an exhaust-gas outlet 5. The second catalytic converter 3 comprises an exhaust-gas inlet 6, which is connected to the exhaust-gas outlet 5 of the first catalytic converter, and an exhaust-gas outlet 7. The exhaust-gas inlet 6 of the second catalytic converter 3 may be arranged vertically above the exhaust-gas outlet 7 of the second catalytic converter.

The first catalytic converter 2 comprises a first flow duct 11 and a second flow duct 12. The second catalytic converter 3 comprises a third flow duct 13. The second flow duct 12 is arranged downstream of the first flow duct 11. The third flow duct 13 is arranged downstream of the second flow duct 12. The second flow duct 12 is arranged spatially at least in part between the first flow duct 11 and the third flow duct 13.

The second flow duct 12 may comprise a device for injecting a reducing agent 28. In addition, the second flow duct 12 may comprise a mixing device 29 for mixing the injected reducing agent with exhaust gas. In the example of FIG. 1 the device for injecting a reducing agent 28 and mixing device 29 are arranged at the exhaust-gas outlet 5 of the first catalytic converter 2.

The first flow duct 11 has a central axis 14. The second flow duct 12 has a central axis 15. The third flow duct 13 has a central axis 16. In the example shown the central axes 14, 15 and 16 are arranged parallel to one another. The second flow duct 12 in the example shown is arranged radially outside the first flow duct 11 and completely or at least partially encloses the latter in a circumferential direction.

That is to say, the first flow duct 11 may correspond to a volume of the first catalytic converter 2, wherein the central axis 14 of the first flow duct 11 may correspond with a center axis of the first catalytic converter 2. In this way, the first catalytic converter 2 and the first flow duct 11 may be concentric with one another.

The second flow duct 12 may comprise a circumference larger than a circumference of the first flow duct 11 and the first catalytic converter 2. As such, the second flow duct 12 may completely surround each of the first flow duct 11 and the first catalytic converter. The central axis 15 of the second flow duct 12 is offset with the central axis 14 due to an arrangement of the first catalytic converter 2. In one example, the first catalytic converter 2 is pressed against a side wall of the second flow duct 12 to maximize a distance between the first catalytic converter 2 and the second catalytic converter 3.

The central axes 14 and 15 are arranged radially offset in relation to one another. The offset is identified by the reference numeral 10. As shown in FIG. 2, this results in an asymmetrical cross-sectional area 20 of the second flow duct 12 relative to at least one radial axis 27. This configuration reduces the required stowage space of the device 1 for the same cross-sectional area, compared to a symmetrical arrangement. A potential stowage space limitation, due to a nearby vehicle component, is identified by the reference numeral 26. The asymmetrical configuration affords a flexible adaptation to the particular stowage space available without adversely affecting the working of the exhaust-gas aftertreatment device.

The central axes may define the direction of flow in the respective flow ducts. Exhaust gas flows through the first flow duct 11 in the direction of flow 17. The direction of flow 17 runs parallel to the central axis 14. The exhaust gas then flows through the second flow duct 12 in the direction of flow 18 as exhaust gas leaves a vicinity of the first catalytic converter 2 to enter a vicinity of the second catalytic converter 3. The exhaust gas in the second flow duct 12 may flow in a direction perpendicular to the direction of flow 18 as it leaves the vicinity of the first catalytic converter 2 and enter the vicinity of the second catalytic converter 3. Here the direction of flow 18 runs parallel to the central axis 15 and counter to the direction of flow 17. In other words, in the variant shown the directions of flow 17 and 18 enclose an angle of 180°. After leaving the second flow duct 12 the exhaust gas flows through the third flow duct 13 in the direction of flow 19. Here the direction of flow 19 runs parallel to the central axis 16 and counter to the direction of flow 18. The directions of flow 18 and 19 in the variant shown therefore enclose an angle of 180°. In the variant shown the directions of flow 17 and 19 furthermore run parallel to one another. Different configurations are likewise possible. Thus, the directions of flow 17 and 18 and/or the directions of flow 18 and 19 may in each case enclose angles of between 135° and 180°.

In the examples shown the first catalytic converter 2 may comprise a lean NOx trap and the second catalytic converter 3 may comprise an SCR filter. Furthermore, in the variants shown a turbocharger 21 having a compressor 22 and a turbine 23, together with an evaporator 24, are arranged upstream of the exhaust-gas aftertreatment device 1.

In FIGS. 1 and 2, the central axes 14, 15 and 16 are each arranged vertically. The directions of flow 17 and 19 thereby point in the direction of gravity. A different arrangement is also possible.

In the variant shown in FIG. 3 the second flow duct 12 has a free-form cross-sectional area 30. In the variant shown the second flow duct 12 only partially encloses the first flow duct 11. This may be particularly advantageous when subject to specific stowage space limitations 26.

In FIGS. 1 to 3, the first flow duct 11 comprises an outside wall 8. The second flow duct 12 likewise comprises an outside wall 9, wherein the outside wall 9 of the second flow duct 12 is at least partially formed by the outside wall 8 of the first flow duct 11. By doing this, a packaging size of the exhaust-gas aftertreatment is reduced.

Said another way, the exhaust gas aftertreatment device 1 comprises a housing 100. The housing 100 may house each of the first catalytic converter apparatus 2 and the second catalytic converter apparatus 3. The first catalytic converter apparatus 2 may comprise a first flow duct 11. The first catalytic converter apparatus 2 may be fitted within the first flow duct 11 such that an outer surface of the first catalytic converter apparatus 2 is pressed against inner surfaces of the first flow duct 11. The second catalytic converter apparatus 3 may comprise a third flow duct 13, wherein the second catalytic converter apparatus 3 may be fitted within the third flow duct 13 such that an outer surface of the second catalytic converter apparatus 3 is pressed against inner surface of the third flow duct 13.

In one example, the first flow duct 11 is arranged in a first portion 101 and/or a first can 101 of the housing 100 and the third flow duct 13 is arranged in a second portion 102 and/or a second can 102 of the housing 100. The first can 101 may be smaller than the second can 102. FIG. 2 illustrates a first diameter 111 of the first can 101 and a second diameter 112 of the second can 102. The first diameter 111 is smaller than the second diameter 112, which may be due to stowage space limitations indicated via dashed arc 26. The first diameter 111 may be equal to a diameter between 50 95% of the second diameter 112.

A third diameter 113, corresponding to first flow duct 11, is illustrated in the example of FIG. 2. The third diameter 113 is less than each of the first and second diameters 111, 112. More specifically, the third diameter is less than the first diameter 111, wherein the third diameter 113 may be equal to a diameter between 50 to 95% of the second diameter 112.

As described above and illustrated in FIGS. 1 and 2, the first flow duct 11, and therefore the first catalytic converter 2, may be fitted within the first can 101 such that the central axis 14 of the first flow duct 11 and the first catalytic converter 2 is misaligned with the central axis 15. In one example, the central axis 15 is a central axis of the first can 101. In some examples, the first flow duct 11 may be pressed against an interior wall of the first can 101, which may maximize a space between the first catalytic converter 2 and the second catalytic converter 3. Such an arrangement is shown in FIG. 2. Additionally or alternatively, the first can 101 may be shaped to overlap only with portions of the first flow duct 11 adjacent to the second flow duct 12. As shown in FIG. 3, material of the first can 101 is trimmed and/or cut and/or removed where the second flow duct 12 is not present. This may decrease a profile of the housing 100. In the example of FIG. 3, the first can 101 may surround less than 80% of the total circumference of the first flow duct 11. In some examples, additionally or alternatively, the first can 101 may surround less than 70% of the total circumference of the first flow duct 11. In some examples, additionally or alternatively, the first can 101 may surround less than 60% of the total circumference of the first flow duct 11. In some examples, additionally or alternatively, the first can 101 may surround less than 60% of the total circumference of the first flow duct 11. In one example, the first can 101 surrounds exactly 50% of the total circumference of the first flow 11.

In the example of FIG. 1, the second flow duct 12 comprises a Z-shape, wherein the second flow duct 12 may be fluidly coupled to an outlet of the first flow duct 11 and to an inlet of the third flow duct 13. In one example, the second flow duct 12 may be a connecting passage, wherein exhaust gases from the first flow duct 11 enter the second flow duct 12 by flowing in a first direction perpendicular to the central axes 14, 15, and 16, then flow in a second direction (e.g., direction of flow 18) parallel to the central axes 14, 15, and 16, then turn and flow in a third direction, opposite to the first direction and perpendicular to the central axes 14, 15, and 16 as the exhaust gas leaves the first can 101 and enters the second can 102. In the second can 102, the exhaust gas may turn and flow in a fourth direction (e.g., direction of flow 19) opposite to the second direction and parallel to the central axes 14, 15, and 16 and to gravity. The exhaust gas may enter the third flow duct 13, and therefore the second catalytic converter 3, as it flows in the fourth direction.

As illustrated in FIG. 1, the first can 101 comprises a first wall 103, which may correspond to a wall shaping the second flow duct 12. The second can 102 comprises a second wall 104, which may be spaced away from the first wall 103 via a gap 105. In the example of FIG. 1, the gap 105 may be free of materials such that ambient gases may freely flow through the gap 105 without mixing with exhaust gases in the housing 100. As will be described herein, the gap 105 may be filled with one or more components to allow the first wall 103 and the second wall 104 to be arranged closer to one another such that a packaging size of the housing 100 may be reduced while mitigating heat transfer from the first can 101 to the second can 102.

In the example of FIG. 3, which may differ from the examples illustrated with respect to FIGS. 1 and 2, the first can 101 may be machined such that a material of the first can 101 is reduced and does not traverse an entire circumference of the first flow duct. As shown in FIG. 3, the first can 101 only traverses the portions of the first flow duct 11 which correspond with a location of the second flow duct 12. By doing this, a packaging size of the aftertreatment device is reduced. Said another way, material of the first can 101 that does not shape the second flow duct 12 is cut and/or trimmed away such that the first can 101 only traverses a portion of the first flow duct 11 corresponding to the second flow duct 12.

In one example, the first flow duct 11 is a housing of the first catalytic converter apparatus 2, wherein outer surfaces of the first catalytic converter apparatus 2 are pressed against interior surfaces of the first flow duct 11. Similarly, the third flow duct 13 may be a housing of the second catalytic converter apparatus 3, wherein outer surface of the second catalytic converter apparatus are pressure against interior surfaces of the third flow duct 13. In this way, all exhaust gas flowing through the first flow duct 11 flows through the first catalytic converter apparatus 2 and all exhaust gas flowing through the third flow duct 13 flows through the second catalytic converter apparatus 3. The second flow duct 12 is free of catalysts and other emission treatment elements that may impede exhaust gas flow.

FIG. 4A shows a device according to the disclosure for exhaust gas aftertreatment device 1 in a perspective view. FIG. 4B schematically shows the device shown in FIG. 4A for exhaust gas after-treatment 1 in a perspective and sectional view. As such, components previously introduced may be similarly numbered in this figure and subsequent figures.

The exhaust gas after-treatment 1 comprises the first catalytic converter apparatus 2 in the first can 101 and the second catalytic converter apparatus 3 in the second can 102. First catalytic converter apparatus 2 comprises an exhaust gas inlet 4 and an exhaust gas outlet 5. Second catalytic converter apparatus 3 comprises the exhaust gas inlet 6 which is connected to exhaust gas outlet 5 of the first catalytic converter apparatus and an exhaust gas outlet 7. First catalytic converter apparatus 2 comprises an outer wall 8. Second catalytic converter apparatus 3 comprises an outer wall 9. In the variant shown, an element for heat insulation in the form of a heat-insulating mat 120 is arranged between outer wall 8 and outer wall 9. More specifically, the heat-insulating mat 120 is arranged between the first wall 103 and the second wall 104, wherein the heat-insulating mat 120 is sandwiched between the first wall 103 and the second wall 104. As illustrated, the gap 105 may be removed such that the gap 105 is no longer arranged between the first wall 103 and the second wall 104.

In one example, the heat-insulating mat 120 is arranged only on a portion of the second wall 104 where the first wall 103 and the second wall 104 meet. As such, a length of the heat-insulating mat 120 may be closer to a length of the first can 101 than the second can 102.

First catalytic converter apparatus 2 comprises the first flow duct 11 and the second flow duct 12. Second catalytic converter apparatus 3 comprises a third flow duct 13. Second flow duct 12 is arranged downstream of first flow duct 11.

Third flow duct 13 is arranged downstream of second flow duct 12. Second flow duct 12 is arranged spatially between first flow duct 11 and third flow duct 13.

First flow duct 11 comprises a central axis 14. Second flow duct 12 comprises a central axis 15. Third flow duct 13 comprises a central axis 16. In the variant shown, central axes 14, 15 and 16 are arranged parallel to one another. In the variant shown, second flow duct 12 is arranged radially outside first flow duct 11. The central axes simultaneously fix the direction of flow in the respective flow ducts. However, exhaust gas flow in the second flow duct may deviate from the central axis 15 as it flows through the exhaust-gas inlet 6.

Exhaust gas flows through first flow duct 11 in direction of flow 17. Direction of flow 17 runs parallel to central axis 14. The exhaust gas subsequently flows through second flow duct 12 in direction of flow 18. Direction of flow 18 runs parallel to central axis 15 and opposite to direction of flow 17. In other words, in the variant shown, directions of flow 17 and 18 enclose an angle of 180°. After leaving second flow duct 12, the exhaust gas flows through third flow duct 13 in direction of flow 19. Direction of flow 19 runs parallel to central axis 16 and opposite to direction of flow 18. Directions of flow 18 and 19 therefore enclose an angle of 180° in the variant shown. Moreover, in the variant shown, directions of flow 17 and 19 run parallel to one another. Configurations which deviate from this are also possible. Directions of flow 17 and 18 and/or directions of flow 18 and 19 can thus enclose in each case angles between 135° and 180°.

Exhaust gas flow from the first flow duct 11, through the second flow duct 12, and to the third flow duct 13 illustrated in the example of FIG. 4B may be substantially similar to the exhaust gas flow described above with respect to FIG. 1. In this way, exhaust gas entering the second can 102 may flow in the third direction, above the second catalytic converter 3, before turning in the fourth direction parallel to gravity and flowing through the second catalytic converter 3.

FIGS. 4A and 4B further illustrate a bracket 122 extending from the first can 101 to the second can 102. More specifically, the bracket 122 extends from a bottom of the first can 101 to a portion of the second wall 104 below an area where the mat 120 is arranged.

In the example shown in FIGS. 5A and 5B, a coating 130 composed of a heat-insulating material is applied on outer wall 9 of second catalytic converter apparatus 3. Alternatively to this, coating 130 can also be applied on outer wall 8 of first catalytic converter apparatus 2 or on the outer walls of both catalytic converter apparatuses 2 and 3. In the variant shown, the coating is only applied in the region of outer wall 9 at which outer walls 8 and 9 of both catalytic converter apparatuses 2 and 3 bear against one another.

Said another way, the coating 130 may be applied to a portion of the second wall 104 directly between the second can 102 and the first can 101. As such, the coating 130 may coat only the portion of the second wall 104 which would otherwise contact the first wall 103 if the coating was absent.

In the example shown in FIGS. 6A and 6B, a sealed-off cavity 140 is present between the outer wall of the first catalytic converter apparatus and the outer wall of the second catalytic converter apparatus. Said cavity 140 is filled, for example, with air. Alternatively, it can be filled with a gas, for example, air, with a pressure below the atmospheric pressure or with vacuum. In this manner, an efficient cooling layer is achieved between catalytic converter apparatuses 2 and 3. Outer walls 8 and 9 can partially also form the walls of cavity 140.

In one example, the cavity 140 may be shaped by the first wall 103 and the second wall 104, wherein a connecting wall may be arranged between the two such that a volume (e.g., cavity 140) between the first wall 103 and the second wall 104 is sealed. The cavity 140 may block at least some heat transfer between the first can 101 and the second can 102.

In the variant shown in FIGS. 7A and 7B, a flow duct 150 in the form of a cavity with a plurality of openings 151 is provided between outer wall 8 of first catalytic converter apparatus 2 and outer wall 9 of second catalytic converter apparatus 3. Air (illustrated via arrows 152) can flow through openings 151 from the outside through cavity 40 and thus bring about cooling of outer walls 8 and 9.

Said another way, the flow duct 150 may be substantially similar to the cavity 140, except that the flow duct 150 is not completely sealed. As such, air may flow through openings of the flow duct 150. In one example, the flow duct 150 may be similar to the gap 105 of FIG. 1, except that the flow duct 150 is partially sealed, wherein the plurality of openings 151 interrupt the seal and allow air to flow therethrough.

In the example shown in FIGS. 8A and 8B, at least one flow duct 40 is provided between outer walls 8 and 9 of catalytic converter apparatuses 2 and 3. Flow duct 40 comprises an inlet 43 and an outlet 44. Through inlet 43, a cooling fluid, for example, a gas or a liquid, in particular air, water or oil, can be conducted through flow duct 40 to outlet 44. In this manner, active cooling of outer surfaces 8 and 9 is enabled.

Said another way, the at least one flow duct 40 may be fluidly coupled to a cooling source, such as an engine coolant jacket, radiator, transmission coolant, transmission lubricant, or other component of the vehicle that may receive coolant and/or lubricant. The at least one flow duct 40 may be shaped similarly to the cavity 140 of FIGS. 6A and 6B, except that the inlet 43 and the outlet 44 allow fluid to circulate through the at least one flow duct 40. In this way, the at least one flow duct 40 may provide active thermal management of the gap between the first can 101 and the second can 102.

FIG. 9 shows a schematic depiction of a hybrid vehicle system 906 that can derive propulsion power from engine system 908 and/or an on-board energy storage device. An energy conversion device, such as a generator, may be operated to absorb energy from vehicle motion and/or engine operation, and then convert the absorbed energy to an energy form suitable for storage by the energy storage device.

Engine system 908 may include an engine 910 having a plurality of cylinders 930. Engine 910 includes an engine intake 923 and an engine exhaust 925. Engine intake 923 includes an air intake throttle 962 fluidly coupled to the engine intake manifold 944 via an intake passage 942. Air may enter intake passage 942 via air filter 952. Engine exhaust 925 includes an exhaust manifold 948 leading to an exhaust passage 935 that routes exhaust gas to the atmosphere. Engine exhaust 925 may include one or more emission control devices 970 mounted in a close-coupled position or in a far underbody position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 908 is a boosted engine system, the engine system may further include a boosting device, such as a turbocharger (not shown).

Vehicle system 906 may further include control system 914. Control system 914 is shown receiving information from a plurality of sensors 916 (various examples of which are described herein) and sending control signals to a plurality of actuators 981 (various examples of which are described herein). As one example, sensors 916 may include exhaust gas sensor 926 located upstream of the emission control device, temperature sensor 928, and pressure sensor 929. Other sensors such as additional pressure, temperature, air/fuel ratio, and composition sensors may be coupled to various locations in the vehicle system 906. As another example, the actuators may include the throttle 962.

Controller 912 may be configured as a conventional microcomputer including a microprocessor unit, input/output ports, read-only memory, random access memory, keep alive memory, a controller area network (CAN) bus, etc. Controller 912 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 906 comprises multiple sources of torque available to one or more vehicle wheels 959. In other examples, vehicle 906 is a conventional vehicle with only an engine, or an electric vehicle with only electric machine(s). In the example shown, vehicle 906 includes engine 910 and an electric machine 951. Electric machine 951 may be a motor or a motor/generator. A crankshaft of engine 910 and electric machine 951 may be connected via a transmission 954 to vehicle wheels 959 when one or more clutches 956 are engaged. In the depicted example, a first clutch 956 is provided between a crankshaft and the electric machine 951, and a second clutch 956 is provided between electric machine 951 and transmission 954. Controller 912 may send a signal to an actuator of each clutch 956 to engage or disengage the clutch, so as to connect or disconnect crankshaft from electric machine 951 and the components connected thereto, and/or connect or disconnect electric machine 951 from transmission 954 and the components connected thereto. Transmission 954 may be a gearbox, a planetary gear system, or another type of transmission. The powertrain may be configured in various manners including as a parallel, a series, or a series-parallel hybrid vehicle.

Electric machine 951 receives electrical power from a traction battery 961 to provide torque to vehicle wheels 959. Electric machine 951 may also be operated as a generator to provide electrical power to charge battery 961, for example during a braking operation.

In this way, an exhaust-gas aftertreatment device may comprises a first catalyst and a second catalyst arranged in close proximity to one another. By arranging the first catalyst in a first can so that a flow duct fluidly coupling the first catalyst to the second catalyst does not flow exhaust gas around an entire circumference of the flow duct, a venturi effect is avoided. The technical effect of avoiding the venturi effect is to promote more uniform exhaust gas distribution through the first and second catalysts. Additionally, the arrangement of the first catalyst may promote some amount of thermal insulation between the first catalyst and the second catalyst, which may further decrease a packaging size of the aftertreatment device.

An embodiment of a system, comprises an exhaust-gas aftertreatment housing comprising a catalytic converter comprising a diameter smaller than a diameter of a can of the exhaust-gas aftertreatment housing, wherein the catalytic converter is pressed against an interior surface of the can.

A first example of the system further comprises where the catalytic converter is a first catalytic converter and the can is a first can, the exhaust-gas aftertreatment housing further comprising a second can housing a second catalytic converter, wherein a diameter of the second catalytic converter is equal to a diameter of the second can.

A second example of the system, optionally including the first example, further comprises where the second can is larger than the first can.

A third example of the system, optionally including one or more of the previous examples, further comprises where the first can is fluidly coupled to the second can, wherein the second catalytic converter is concentric with the second can.

A fourth example of the system, optionally including one or more of the previous examples, further comprises where exhaust gas from the first can flows through a duct arranged between the first catalytic converter and a first wall of the first can, wherein the first wall is opposite to the interior surface and is a wall of the first can nearest to the second can, wherein the duct fluidly couples the first can to the second can.

A fifth example of the system, optionally including one or more of the previous examples, further comprises where an injector is arranged in the second can upstream of the second catalytic converter, wherein exhaust gas flow through the second catalytic converter is in a direction of gravity.

An embodiment of an exhaust-gas treatment apparatus comprises a housing comprising a first can comprising a first catalytic converter and a second can comprising a second catalytic converter, wherein a second can diameter is larger than a first can diameter, the first can diameter being larger than a first catalytic converter diameter, wherein a central axis of the first catalytic converter is misaligned with a central axis of the first can.

A first example of the exhaust-gas aftertreatment apparatus further comprises where the first catalytic converter is pressed against an interior surface of the first can, wherein the interior surface is an interior surface of the first can farthest away from the second can.

A second example of the exhaust-gas aftertreatment apparatus, optionally including the first example, further comprises where a first flow duct flows exhaust gas through the first catalytic converter, wherein a second flow duct flows exhaust gas from an outlet of the first catalytic converter in the first can to an inlet of the second catalytic converter in the second can, wherein a third flow duct flows exhaust gas through the third catalytic converter.

A third example of the exhaust-gas aftertreatment apparatus, optionally including one or more of the previous examples, further comprises where the second flow duct is arranged between a first wall of the first can and the first catalytic converter, wherein the first wall is a wall of the first can nearest to the second can.

A fourth example of the exhaust-gas aftertreatment apparatus, optionally including one or more of the previous examples, further comprises where the second can comprises a second wall proximal to the first wall, wherein a gap is present between the first wall and the second wall.

A fifth example of the exhaust-gas aftertreatment apparatus, optionally including one or more of the previous examples, further comprises where the second can comprises a second wall proximal to the first wall, wherein the first wall and the second wall sandwich a thermally isolating material.

A sixth example of the exhaust-gas aftertreatment apparatus, optionally including one or more of the previous examples, further comprises where the thermally isolating material is a mat, a coating, a sealed cavity, a flow duct, or a cooling jacket.

A seventh example of the exhaust-gas aftertreatment apparatus, optionally including one or more of the previous examples, further comprises where the flow duct is a partially sealed cavity comprising a plurality of openings configured to permit gas flow therethrough without entering the housing.

An eighth example of the exhaust-gas aftertreatment apparatus, optionally including one or more of the previous examples, further comprises where the cooling jacket comprises coolant, wherein an inlet is configured to flow coolant into the coolant jacket and an outlet is configured to flow coolant out of the coolant jacket.

A ninth example of the exhaust-gas aftertreatment apparatus, optionally including one or more of the previous examples, further comprises where a length of the first can measured along the central axis of the first can is less than a length of the second can measured along a central axis of the second can, wherein the central axis of the first can is parallel to the central axis of the second can.

An embodiment of a vehicle comprises an engine fluidly coupled to an exhaust passage, an aftertreatment housing arranged along the exhaust passage, the aftertreatment housing comprising a first can and a second can fluidly coupled to one another, a first catalytic converter arranged in the first can and a second catalytic converter arranged in the second can, wherein the first catalytic converter is pressed against an interior surface of the first can to maximize a space between the first catalytic converter and the second can, and a thermally-insulating device arranged between a first wall of the first can and a second wall of the second can, wherein the first wall is opposite the interior surface and corresponds to a wall of the first can nearest the second can.

A first example of the vehicle further comprises where a diameter and a length of the first can are less than a diameter and a length of the second can.

A second example of the vehicle, optionally including the first example, further comprises where the aftertreatment housing is a single piece.

A third example of the vehicle, optionally including one or more of the previous examples, further comprises where a gap between the first catalytic converter and the first wall, wherein exhaust gases from the first catalytic converter flow through the gap and into the second can toward the second catalytic converter.

An example of an exhaust-gas aftertreatment device which comprises a first catalytic converter and a second catalytic converter following the first catalytic converter in the direction of flow of the exhaust gas, wherein the first and the second catalytic converter are arranged spatially adjoining one another, the first catalytic converter comprises a first flow duct and a second flow duct and the first catalytic converter is designed to carry exhaust gas through the first flow duct in a first direction of flow and then to carry it through the second flow duct in a second direction of flow running counter to the first direction of flow, the second catalytic converter comprises a third flow duct, wherein the second flow duct is arranged, spatially and in terms of the flow, between the first flow duct and the third flow duct, and the second catalytic converter is designed to carry exhaust gas leaving the second flow duct through the third flow duct in a third direction of flow running counter to the second direction of flow, characterized in that the first flow duct has a central axis and the second flow duct has a central axis, which is arranged radially offset in relation to the central axis of the first flow duct.

The device further comprises where the first flow duct comprises an outside wall, the second flow duct comprises an outside wall and at least a part of the outside wall of the first flow duct forms at least a part of the outside wall of the second flow duct. The device further comprises where the second flow duct at least partially encloses the first flow duct in a circumferential direction. The device further comprises where the second flow duct completely encloses the first flow duct in a circumferential direction. The device further comprises where the second flow duct has a cross-sectional area, which has the shape of an open or closed ring. The device further comprises where the second flow duct has an asymmetrical cross-sectional area at least in relation to a radial axis. The device further comprises where the second flow duct has a free-form cross-sectional area. The device further comprises where the first flow duct has a central axis and/or the second flow duct has a central axis and/or the third flow duct has a central axis and the central axes in each case enclose an angle of 0 degrees to 45 degrees. The device further comprises where the central axes in each case enclose an angle of 0 degrees to 20 degrees. The device further comprises where the first direction of flow and the second direction of flow and/or the second direction of flow and the third direction of flow enclose an angle of 135 degrees to 225 degrees. The device further comprises where at least one of the catalytic converters comprises a lean NOx trap and/or an SCR catalytic converter and/or a diesel particle filter.

Additionally or alternatively, the device may further comprise where the second flow duct of the first catalytic converter device comprises an apparatus for injecting a reducing agent. The device may further comprise where the second flow duct of the first catalytic converter device comprises an apparatus for mixing a reducing agent with exhaust gas. The device may further comprise where the first flow duct comprises an exhaust-gas outlet, the third flow duct comprises an exhaust-gas inlet, and the second flow duct comprises a first end and a second end, the first end being arranged at the exhaust-gas outlet of the first flow duct and the second end being arranged at the exhaust-gas inlet of the third flow duct and the apparatus for injecting and/or the apparatus for mixing being arranged at the first end of the second flow duct or at the second end of the second flow duct. The device may further comprise where the third flow duct comprises an exhaust-gas inlet and an exhaust-gas outlet, the exhaust-gas inlet being arranged in a vertical direction above the exhaust-gas outlet and the apparatus for injecting and/or the apparatus for mixing being arranged in a vertical direction above the exhaust-gas inlet of the third flow duct. The device may further comprise where the first flow duct comprises a center axis and/or the second flow duct comprises a center axis and/or the third flow duct comprises a center axis and the center axes each include an angle of 0 degrees to 45 degrees. The device may further comprise where the first direction of flow and the second direction of flow and/or the second direction of flow and the third direction of flow include an angle of 135 degrees to 225 degrees. The device may further comprise where at least one of the catalytic converter devices comprises a diesel particulate filter and/or an SCR catalytic converter and/or a lean NOx trap. The device may further comprise where the second flow duct radially surrounds the first flow duct. The device may further comprise where exhaust gas is conducted into the first flow duct of the first catalytic converter device, a reducing agent is injected into the exhaust gas leaving the first flow duct in the region of the second flow duct via the apparatus for injecting, and the exhaust gas is then conducted into the second catalytic converter device. The device may further comprise where the exhaust gas is mixed with the injected reducing agent via an apparatus for mixing.

In some examples, the device may further comprise at least one element for heat insulation is arranged spatially between the first catalytic converter apparatus and the second catalytic converter apparatus. The device may further comprise where the element for heat is arranged spatially between the second flow duct and the third flow duct. The device may further comprise where the first catalytic converter apparatus and the second catalytic converter apparatus comprise in each case an outer wall and the element for heat insulation is arranged between the outer wall of the first catalytic converter apparatus and the outer wall of the second catalytic converter apparatus. The device may further comprise where the first flow duct comprises a central axis and/or the second flow duct comprises a central axis and/or the third flow duct comprises a central axis and the central axes enclose in each case an angle of between 0 degrees and 45 degrees. The device may further comprise where the first direction of flow and the second direction of flow and/or the second direction of flow and the third direction of flow enclose an angle of between 135 degrees and 225 degrees. The device may further comprise where at least one of the catalytic converter apparatuses comprises a diesel particle filter. The device may further comprise where the element for heat insulation comprises a mat. The device may further comprise where the element for heat insulation comprises a coating. The device may further comprise where the element for heat insulation comprises at least one sealed-off cavity. The device may further comprise where the element for heat insulation comprises a number of flow ducts.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an exhaust-gas aftertreatment housing comprising a first can comprising a first catalytic converter and a second can comprising a second catalytic converter, the first can arranged upstream of the second can, wherein the first catalytic converter comprising a diameter smaller than a diameter of the first can, and wherein the first catalytic converter is pressed against an interior surface of the first can.

2. The system of claim 1, wherein the second can is larger than the first can.

3. The system of claim 1, wherein the first can is fluidly coupled to the second can via a flow duct between a first wall of the first can and the first catalytic converter, wherein the first wall is a wall of the first can nearest to the second can, and wherein the second catalytic converter is concentric with the second can.

4. The system of claim 3, where exhaust gas from the first can flows through a duct arranged between the first catalytic converter and a first wall of the first can, wherein the first wall is opposite to the interior surface and is a wall of the first can nearest to the second can, wherein the duct fluidly couples the first can to the second can.

5. The system of claim 1, wherein an injector is arranged in the second can upstream of the second catalytic converter, wherein exhaust gas flow through the second catalytic converter is in a direction of gravity.

6. An exhaust-gas treatment apparatus, comprising:

a housing comprising a first can comprising a first catalytic converter and a second can comprising a second catalytic converter, the first can arranged upstream of the second can, wherein a second can diameter is larger than a first can diameter, the first can diameter being larger than a first catalytic converter diameter, wherein a central axis of the first catalytic converter is misaligned with a central axis of the first can.

7. The exhaust-gas treatment apparatus of claim 6, wherein the first catalytic converter is pressed against an interior surface of the first can, wherein the interior surface is an interior surface of the first can farthest away from the second can.

8. The exhaust-gas treatment apparatus of claim 6, wherein a first flow duct flows exhaust gas through the first catalytic converter, wherein a second flow duct flows exhaust gas from an outlet of the first catalytic converter in the first can to an inlet of the second catalytic converter in the second can, wherein a third flow duct flows exhaust gas through the second catalytic converter.

9. The exhaust-gas treatment apparatus of claim 8, wherein the second flow duct is arranged between a first wall of the first can and the first catalytic converter, wherein the first wall is a wall of the first can nearest to the second can.

10. The exhaust-gas treatment apparatus of claim 9, wherein the second can comprises a second wall proximal to the first wall, wherein a gap is present between the first wall and the second wall.

11. The exhaust-gas treatment apparatus of claim 9, wherein the second can comprises a second wall proximal to the first wall, wherein the first wall and the second wall sandwich a thermally isolating material.

12. The exhaust-gas treatment apparatus of claim 11, wherein the thermally isolating material is a mat, a coating, a sealed cavity, a flow duct, or a cooling jacket.

13. The exhaust-gas treatment apparatus of claim 12, wherein the flow duct is a partially sealed cavity comprising a plurality of openings configured to permit gas flow therethrough without entering the housing.

14. The exhaust-gas treatment apparatus of claim 12, wherein the cooling jacket comprises coolant, wherein an inlet is configured to flow coolant into the coolant jacket and an outlet is configured to flow coolant out of the coolant jacket.

15. The exhaust-gas treatment apparatus of claim 6, wherein a length of the first can measured along the central axis of the first can is less than a length of the second can measured along a central axis of the second can, wherein the central axis of the first can is parallel to the central axis of the second can.

16. A vehicle, comprising:

an engine fluidly coupled to an exhaust passage;

an aftertreatment housing arranged along the exhaust passage, the aftertreatment housing comprising a first can and a second can fluidly coupled to one another;

a first catalytic converter arranged in the first can and a second catalytic converter arranged in the second can, the first can arranged upstream of the second can, wherein the first catalytic converter is pressed against an interior surface of the first can to maximize a space between the first catalytic converter and the second can; and a thermally-insulating device arranged between a first wall of the first can and a second wall of the second can, wherein the first wall is opposite the interior surface and corresponds to a wall of the first can nearest the second can.

17. The vehicle of claim 16, wherein a diameter and a length of the first can are less than a diameter and a length of the second can.

18. The vehicle of claim 16, wherein the aftertreatment housing is a single piece.

19. The vehicle of claim 16, further comprising a gap between the first catalytic converter and the first wall, wherein exhaust gases from the first catalytic converter flow through the gap and into the second can toward the second catalytic converter.

* * * * *